US009012796B2

(12) United States Patent
Cour et al.

(10) Patent No.: US 9,012,796 B2
(45) Date of Patent: Apr. 21, 2015

(54) THIN ELECTRICAL SWITCH

(75) Inventors: Michel Cour, Sampans (FR); Jean-Christophe Villain, Dole (FR)

(73) Assignee: CoActive Technologies, LLC, Newton, MA (US)

( * ) Notice: Subject to any disclaimer, the term of this patent is extended or adjusted under 35 U.S.C. 154(b) by 374 days.

(21) Appl. No.: 13/292,292

(22) Filed: Nov. 9, 2011

(65) Prior Publication Data

US 2012/0111712 A1 May 10, 2012

(30) Foreign Application Priority Data

Nov. 9, 2010 (FR) ..... 10 59221

(51) Int. Cl.
*H01H 13/48* (2006.01)
*H01H 13/84* (2006.01)

(52) U.S. Cl.
CPC ..... *H01H 13/48* (2013.01); *H01H 13/84* (2013.01); *H01H 2203/002* (2013.01); *H01H 2211/004* (2013.01); *H01H 2215/012* (2013.01); *H01H 2215/018* (2013.01); *H01H 2223/002* (2013.01); *H01H 2227/036* (2013.01); *H01H 2231/022* (2013.01)

(58) Field of Classification Search
CPC ..... H01H 13/48; H01H 13/06
USPC ..... 200/406
See application file for complete search history.

(56) References Cited

U.S. PATENT DOCUMENTS

| | | | | |
|---|---|---|---|---|
| 6,936,777 | B1 * | 8/2005 | Kawakubo | 200/1 B |
| 6,946,610 | B2 | 9/2005 | Takeuchi et al. | |
| 7,196,280 | B2 * | 3/2007 | Rochon | 200/406 |
| 7,378,609 | B1 * | 5/2008 | Fedorjaka | 200/406 |
| 7,429,707 | B2 * | 9/2008 | Yanai et al. | 200/1 B |
| 7,589,607 | B2 * | 9/2009 | Rochon et al. | 335/205 |
| 2012/0020045 | A1 * | 1/2012 | Tanase | 361/807 |

* cited by examiner

*Primary Examiner* — Renee Luebke
*Assistant Examiner* — Ahmed Saeed
(74) *Attorney, Agent, or Firm* — Fox Rothschild LLP

(57) ABSTRACT

An electrical switch which includes a top metal support plate, a triggering member bearing on a bottom of a recess, a bottom metal contact plate having a fixed central contact region, and an adhesive fixing insulating sheet. The adhesive insulating sheet is arranged between a peripheral portion of the bottom face of the top support plate and a peripheral portion of the top face of the bottom contact plate and the adhesive insulating sheet adheres, by its two opposite faces, to each of said two annular portions to form a means for fixing the top support plate to the bottom contact plate.

6 Claims, 6 Drawing Sheets

THIN ELECTRICAL SWITCH

CROSS REFERENCE TO RELATED APPLICATION

This application claims priority to France Patent Application No. 1059221 filed Nov. 9, 2010, the content of which is hereby incorporated by reference in its entirety.

BACKGROUND

The present disclosure relates to an electrical switch. More specifically, the present disclosure relates to a thin electrical switch used in electrical appliances such as portable telephones, digital cameras, and other similar types of mobile or portable products in which the miniaturization of the components is a significant parameter in the design and production.

In conventional designs, a thin electrical switch typically has a domed triggering member in the form of a spherical cap. An abrupt change of state of the triggering member provides a user with a tactile sensation indicated the state change. The electrical switch also typically includes a bottom contact plate, or base, which is produced by over-molding a material, such as plastic, to delimit a recess which receives the elastically deformable triggering dome.

In a typical design, such as the design illustrated in U.S. Pat. No. 6,946,610, the content of which is hereby incorporated by reference in its entirety, when seeking to reduce the dimensions and, in particular, the thickness of the over-molded plastic material, the arrangement of components results such that when a force is applied to provoke the triggering, and subsequent state change of the switch, various metallic parts and the over-molded plastic components may separate by delamination, leading to a potential failure of the switch.

To reduce the dimensions and the thickness of a switch, it is possible to produce the switch in association with a bottom plate including one or more printed circuits, thereby reducing the number and size of individual components within the switch. The triggering member dome is placed directly in contact with a conductive track or conductive tracks on the print circuit as is illustrated, for example, in U.S. Pat. No. 7,378,609, the content of which is hereby incorporated by reference in its entirety. However, as the thickness of the bottom plate is reduced, it becomes flexible. For optimum performance, the triggering member, by its circular bottom edge, should be bearing on a perfectly flat surface in order to operate reliably and sustainably. If the bottom plate flexes in response to a force being applied to the triggering member, the triggering member may not completely contact the conductive tracks. Additionally, this solution is costly because it does not allow for the implementation of a mass production line manufacturing method.

U.S. Pat. No. 7,589,607, the content of which is hereby incorporated by reference in its entirety, proposes a structure in which the domed triggering member, having small dimensions, is linked by a tab to a surrounding metal plate. Such an arrangement is not practical or satisfactory for a majority of applications as the domed triggering member does not freely move and the life of the switch is particularly reduced.

SUMMARY

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this document is to be construed as an admission that the embodiments described in this document are not entitled to antedate such disclosure by virtue of prior invention. As used in this document, the term "comprising" means "including, but not limited to."

The present disclosure aims to propose an electrical switch having a small thickness that remedies the abovementioned drawbacks. To this end, the present disclosure proposes an electrical switch comprising a top support plate which is produced in the form of a metal plate cut and shaped to delimit a recess that has an annular bottom which delimits an open central hole; a triggering member, electrically conducting, of generally convex shape which is elastically deformable from a stable rest position, in a direction substantially perpendicular to the bottom of the recess, and a bottom edge of which bears, vertically downward, on a facing top face of said annular bottom; a bottom contact plate which is produced in the form of a cut metal plate which has a fixed central contact region which is arranged facing said central hole and facing a conductive central portion of the bottom face of the triggering member; and an adhesive fixing insulating sheet, with a central hole, wherein the insulating sheet is arranged vertically between a peripheral portion of the bottom face of the top support plate and a peripheral portion of the top face of the bottom contact plate and adheres by its two opposite faces to each of said two peripheral portions to form a means for fixing the top support plate to the bottom contact plate.

By virtue of this design, a rigid, ultra-thin switch is produced solely by means of a metal structure, without over-molding. In addition, all the components are fixed together by adhesive films or sheets and its manufacture is particularly easy in a production line, in mass production.

According to other characteristics of the invention, the switch comprises an actuating member mounted in a movable manner relative to the top support plate in a direction substantially perpendicular to the bottom of the recess in order to act, directly or indirectly, on the top face of the central portion of the triggering member; the switch comprises a solid top closing film, the bottom face of which adheres to a peripheral region of the top face to the top support plate; the bottom contact plate is produced in the form of a cut metal plate and shaped to include said fixed central contact region shaped into a boss which extends in a protruding manner, slightly offset vertically relative to the flat bottom face of the top support plate; the triggering member is in the form of a spherical cap, in that said recess has a concave cylindrical shape, and in that the diameter of the circular bottom edge of the triggering member is received with a radial play in this recess; and the top support plate includes at least one connection terminal produced in the form of a cut and bent peripheral lead which extends vertically downward.

BRIEF DESCRIPTION OF THE DRAWINGS

Other features and advantages of the invention will become apparent from reading the following detailed description, for an understanding of which reference will be made to the appended drawings in which.

DETAILED DESCRIPTION

Figure 1:
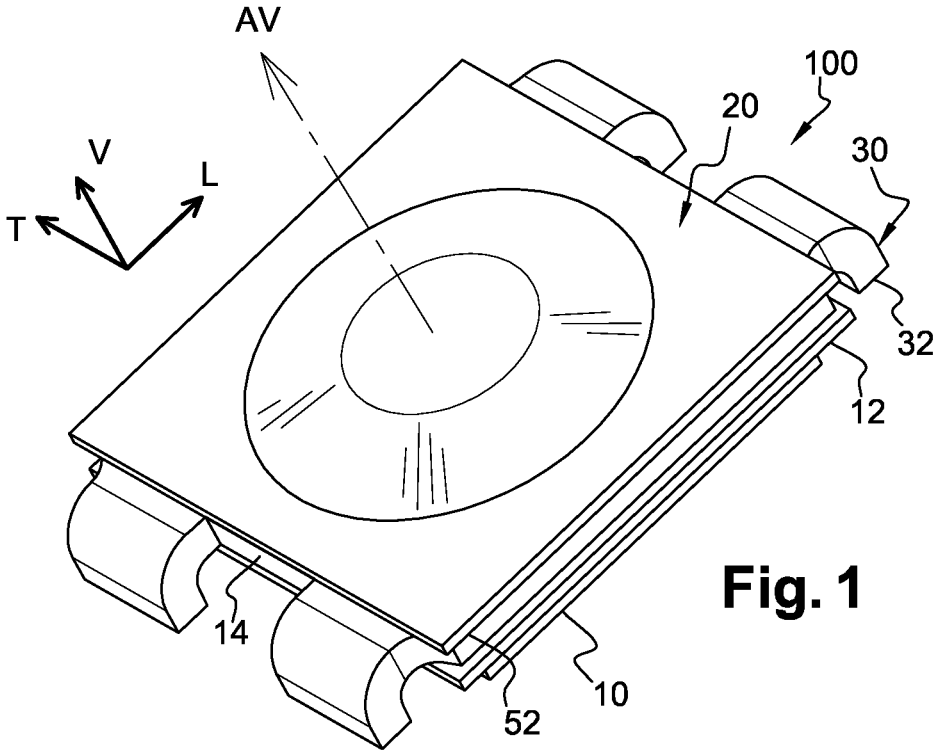
FIG. 1 illustrates a large scale perspective view of a unitary electrical switch produced in accordance with an embodiment of the invention.
Figure 2:
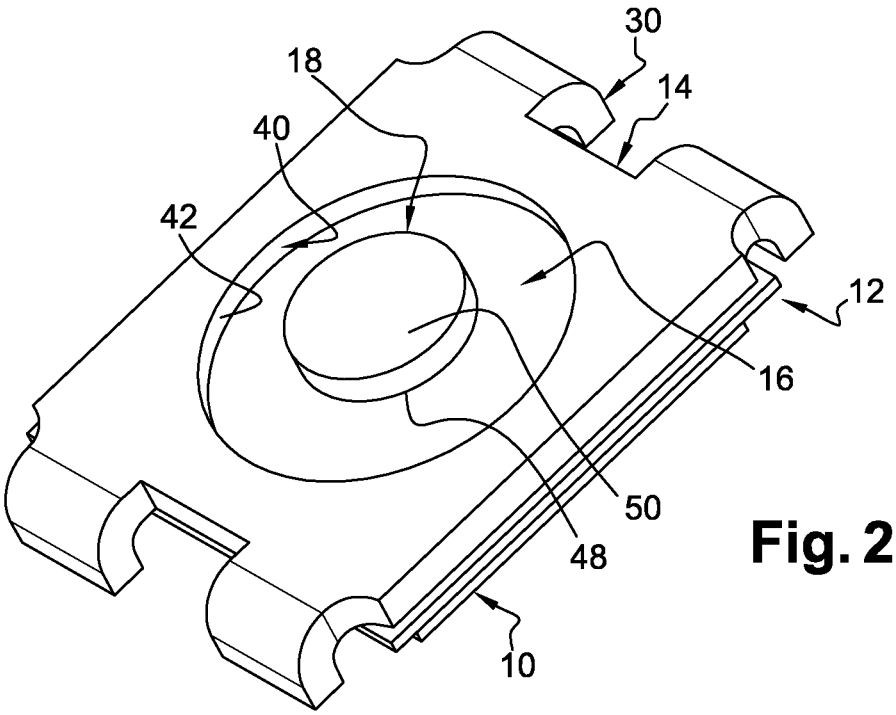
FIG. 2 illustrates a view similar to that of FIG. 1, in which the electrical switch is shown without a top sealing film.
Figure 3:
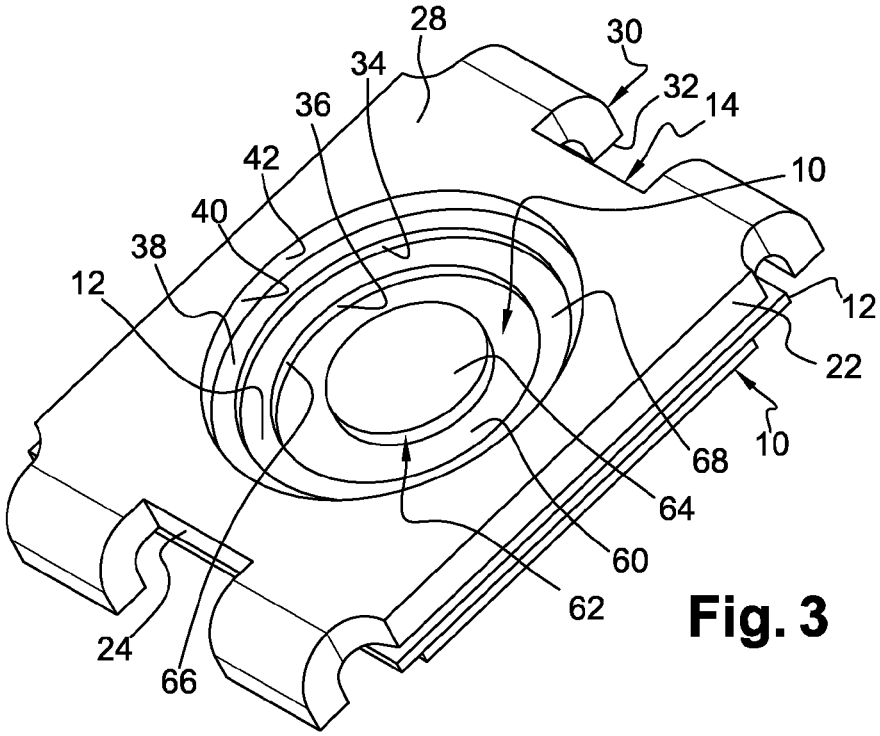
FIG. 3 illustrates a view similar to that of FIG. 2, in which the electrical switch is shown without a triggering member and an actuating member.
Figure 5:
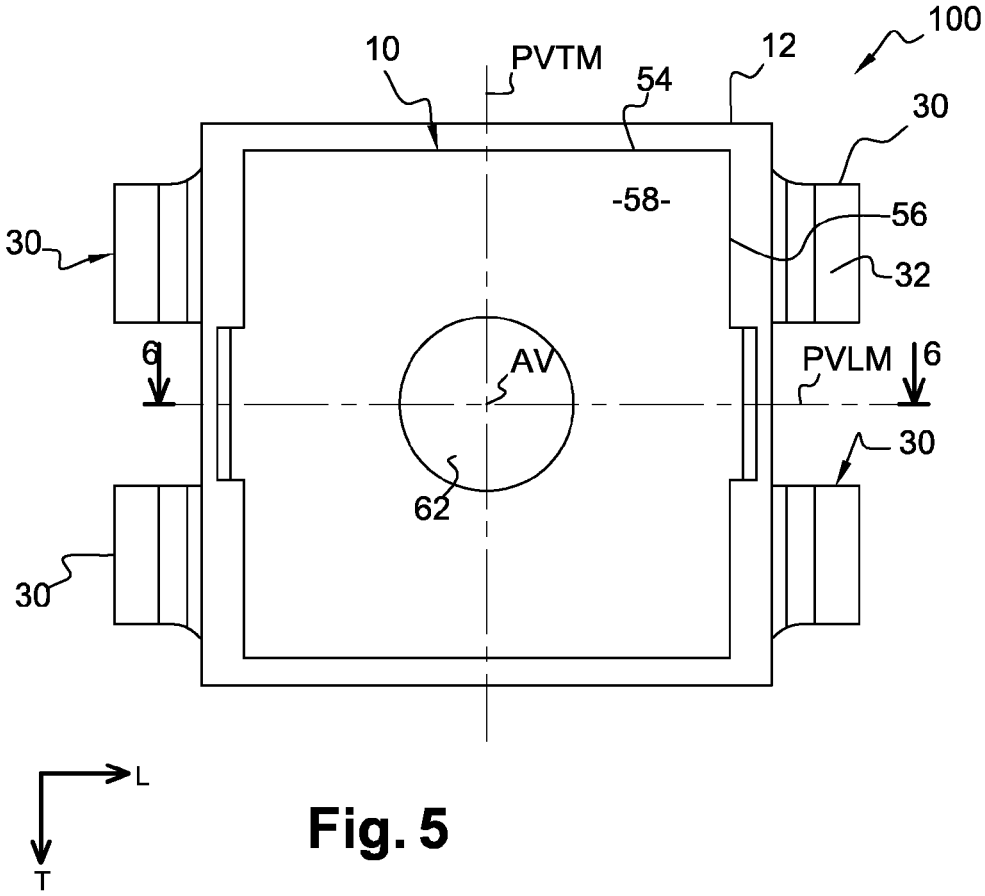
FIG. 5 illustrates a bottom view of the electrical switch of FIG. 1.
Figure 4:
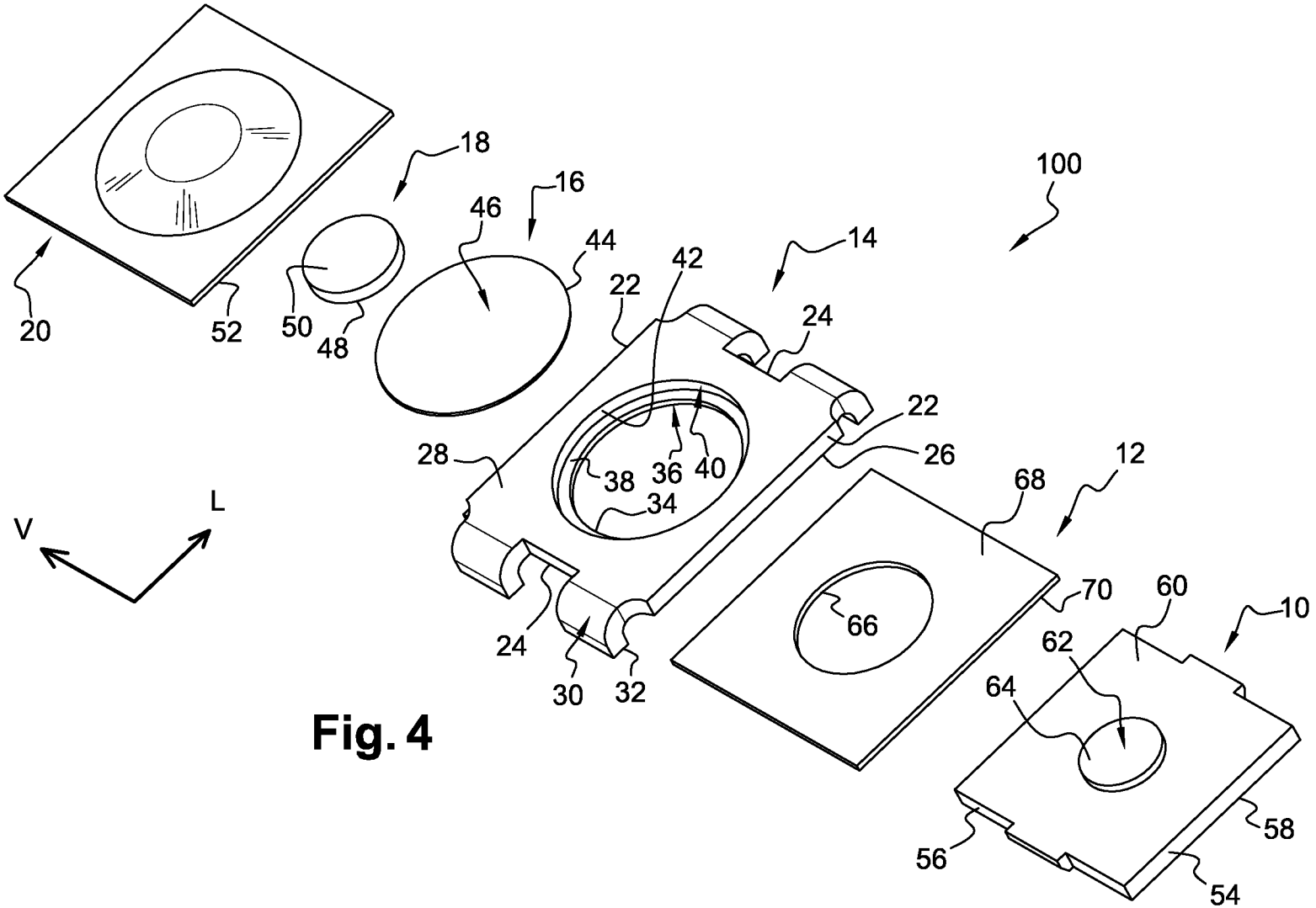
FIG. 4 illustrates an exploded perspective view of the electrical switch of FIG. 1.
Figure 6:
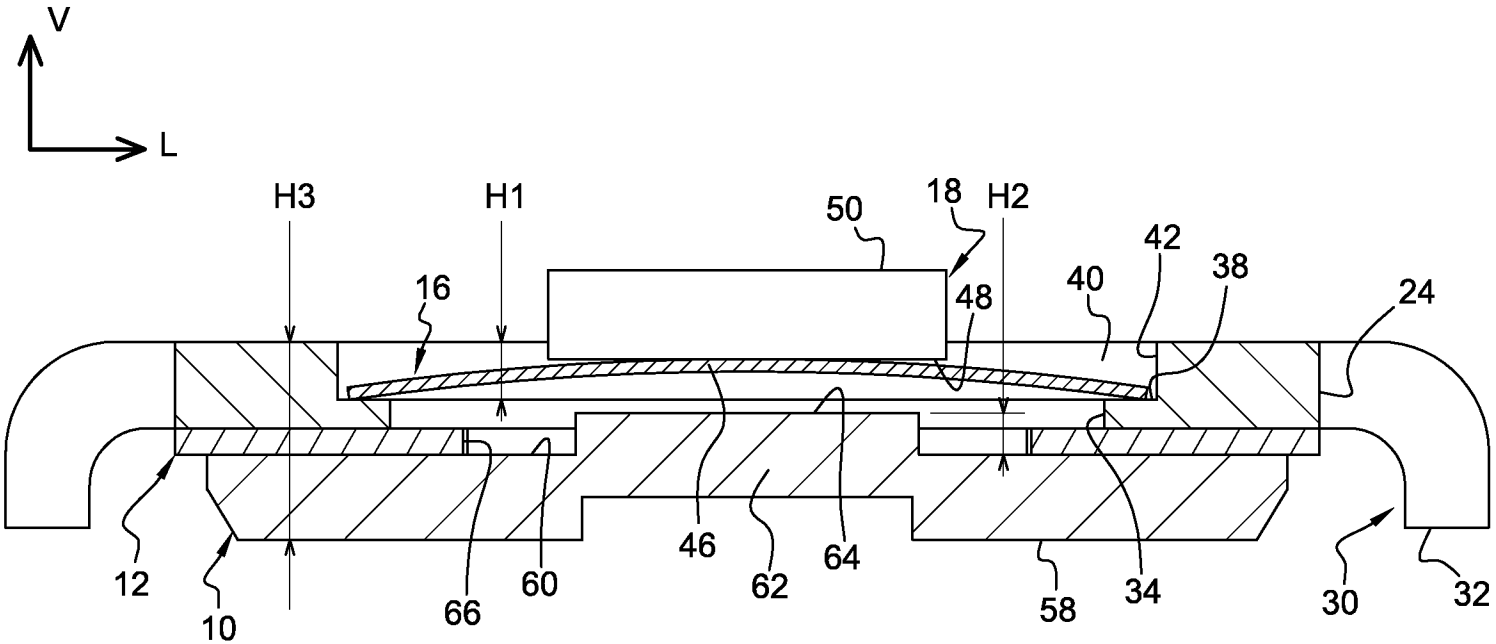
FIG. 6 illustrates a cross-sectional view along the line 6-6 of FIG. 5.

In the following description, to make it easier to understand the description of the claims, the expressions vertical, longitudinal and transversal will be used in a non-limiting way and without referenced to the earth's gravity with reference to the V, L, T trihedron indicated in the figures. Additionally, identical, analogous or similar components will be designated by the same reference numerals.

FIGS. 1 to 6 illustrate an exemplary unitary electrical switch 100. The switch 100 may be produced as a discrete component having a normally-open type single switching pathway. The electrical switch 100 may be a switch of small dimensions, which is in particular characterized by its small overall thickness. The electrical switch 100 as shown herein represents a double symmetry of design relative to the longitudinal PVLM and transversal PVTM median vertical planes as shown, for example, in FIG. 5.

From bottom to top, the switch 100 may include the vertical stacking of six components:

a bottom contact plate 10;

an adhesive fixing and sealing insulating sheet 12;

a top support plate 14;

a triggering member 16;

an actuating member 18; and a closing and sealing top film 20.

The top support plate 14 is the main structural component of the electrical switch 100. It may be produced from metal plate that has been cut and shaped, in particular by stamping and bending. The top support plate 14 may be of a generally rectangular form and may be laterally delimited by two parallel vertical longitudinal faces 22, two transversal lateral parallel faces 24, and two flat bottom 26 and top 28 horizontal parallel faces. The thickness of the top support plate 14 may be equal to approximately 0.15 millimeters.

To improve the fixing capabilities and mechanical strength of the electrical switch 100, e.g., if mounted on the top face of a printed circuit board (not represented), the top support plate 14 may also include two pairs of leads 30 arranged at the corners of the top support plate 14, each of which may extend horizontally from a transversal lateral face 24 and be bent vertically downwards at a right angle, ending with a horizontal end face 32. Each lead 30 may also constitute an electrical connection terminal for connecting the top support plate 14 to a conductive track of the top face of the printed circuit board.

The top support plate 14 may also include a circular central hole 34 which opens vertically with respect to the other components of switch 100. The central hole 34 may delimit, radially towards the interior, a shoulder 36, an annular and horizontal face 38 that constitutes a bottom of a recess 40. The recess 40 may be dimensioned to receive, with play, and to house the triggering member 16. The recess 40 may be laterally delimited by a circular cylindrical vertical edge 42. A height H1 separating the faces 28 and 38 of the top support plate 14 may be equal to approximately 0.1 millimeters.

The triggering member 16 may be an element made of conductive material of a generally convex shape, e.g., in the form of a spherical cap, which is positioned to bear against the bottom 38 by its bottom lateral edge 44 with a circular contour and the central portion 46, which may be substantially centered on the vertical axis AV of the electrical switch 100 as indicated in FIG. 1. An outer diameter of the circular bottom lateral edge 44 of the triggering member 16 may be less than an internal diameter of the concave cylindrical wall of the recess 40 so that the triggering member 16 is received with radial play and free of movement in the horizontal plane by bearing on the annular bottom 38. The concavity of the triggering member 16 may faces downward and toward the bottom 38, and the triggering member 16 may be deformed, against its natural elasticity, in the vertical triggering direction AV, to make an electrical link which will be described hereinbelow.

The triggering member 16 may be stable and change state abruptly, beyond a determined triggering travel, so as to transmit to the user a tactile triggering sensation. The actuating means of the triggering member 16 here, by way of non-limiting example, includes the actuating member 18 incorporated in the switch 100 as a pushbutton in the form of a pad with circular contour. The actuating member 18 may be glued and centered, by its flat bottom face 48, on the top face of the central portion 46 of the triggering member 16. The actuating member 18 may extend vertically, protruding above the top face 28 of the top support plate 14.

At its top, the electrical switch 100 may be closed in a seal-tight manner by the top closing film 20, a solid flexible film having an adhesive bottom face 52. Thus, the bottom face 52 of the top closing film 20 may be glued to the top face 28 of the top support plate 14, around the recess 40. The top closing film may also be glued to the top face 50 of the actuating member 18.

The bottom contact plate 10 may be of a generally rectangular shape and be laterally delimited by two parallel vertical longitudinal faces 54, two parallel vertical transversal faces 56, and two flat bottom 58 and top 60 parallel horizontal faces. An exemplary thickness of the bottom contact plate 10 may be equal to approximately 0.2 millimeters. The bottom contact plate 10 may be produced from a metal plate that is cut and shaped, in particular by stamping and bending.

A central region of the bottom contact plate 10 may include a fixed contact central part 62 which is stamped, vertically upward, in the form of a boss or pad that may constitute a fixed central contact region and that is centered on the axis AV. The central part 62 may be arranged facing the conductive bottom face of the central portion 46 of the triggering member 16 and of the actuating member 18. The topmost point 64 of the top face of the fixed contact part 62 may be slightly offset relative to the flat bottom face 26 of the top support plate 14, and the contact part 62 may extend partly through the central hole 34. The top face 64 may be flat or convex, and its surface may be smooth or provided with relief points. The height H2 separating the top face 60 from the topmost point of the top face 64 may be equal to approximately 0.1 millimeters.

To ensure that the bottom contact plate 10 is fixed to the top support plate 14, and to ensure a seal-tight closure, toward the bottom of the recess 40, the electrical switch 100 may include the adhesive fixing insulating sheet 12. The insulating sheet 12 may include a central circular hole 66. An adhesive top face 68 of the adhesive fixing insulating sheet 12 may be arranged vertically and be glued to a peripheral portion, of generally annular form, facing the bottom face 26 of the top support plate 14. A bottom face 70 of the adhesive fixing insulating sheet 12 may be glued to a peripheral portion, of generally annular form, facing the top face 60 of the bottom contact plate 10. Thus, the adhesive fixing insulating sheet 12 may adhere by its two opposite faces 68 and 70 to each of said two annular portions to form a means for fixing the top support plate 14 to the bottom contact plate 10 and a seal-tight closure means for the recess 40.

In an exemplary embodiment, the adhesive fixing insulating sheet 12 has a thickness of between 50 microns and 150 microns. The adhesive fixing insulating sheet 12 may be, for example, produced in the form of a layer of glue. In an alternative embodiment, the adhesive fixing insulating sheet 12 may include an electrically insulating support film which is covered on each face with a layer of an adhesive.

As described above, an overall thickness H3 of the switch 100 may be equal to approximately 0.4 millimeters.

The electrical switch 100 which has just been described operates as follows. When the user applies a force vertically downwards from above, along the axis AV, on the summit of the switch consisting of the top face of the closing and sealing top film 20, it acts here on the actuating member 18, which acts on the triggering member 16 by provoking, beyond a certain axial travel, an abrupt change of state thereof. This deformation and change of state of the triggering member 16 causes the bottom face of its central region 46 to bear on and make electrical contact with the top face of the fixed contact part 62. Thus, an electrical contact is made between the top support plate 14, which is metallic and electrically conductive, and the bottom contact plate 10, which is also metallic and electrically conductive, these two plates being normally separated and insulated from one another by the adhesive fixing insulating sheet 12. An electrical switching pathway is thus made between these two plates, and therefore between the conductive tracks of the printed circuit board linked to the terminals 30 and to the bottom contact plate 10, respectively.

The abrupt change of state of the triggering member 16 may provoke a tactile sensation that is perceptible to the user. When the user releases the force, the triggering member 16 is elastically returned to its rest state, this change of state causing the electrical switching pathway previously made to be broken, the electrical switch 100 reverting to its normally-open state.

The electrical switch 100 according to the invention has small dimensions. In an exemplary embodiment, these dimensions overall are approximately 2 millimeters by 2.5 millimeters (for a diameter of the triggering dome 18 equal to approximately 1.5 millimeters), wherein its thickness is reduced to approximately 0.5 millimeter. In an embodiment, the switch 100 may be rigid because it is mainly made of metal in as its main parts, e.g., the two plates 10 and 14, are formed from metal. Additionally, the dome-shaped triggering member 16 may have a base, including its bottom horizontal edge 44, which is flat and bears on the annular bottom 38 of the recess 40, so the life of the triggering member 16 is thus maximized.

Manufacturing costs for the switch 100 are particularly low, notably because the bottom contact plate 10 can be produced at high speed by cutting, when this technique is compared to the conventional technique of over-molding an insulating plastic material. The manufacture of the top support plate 14 by cutting and stamping from a plate makes it possible to produce, in a very thin plate of controlled thickness, a recess having a flat annular bottom. The same applies for the production of the bottom contact plate 10. The top plate 14, apart from the central hole, is solid and uniform and therefore rigid, in the same way as for the bottom plate 10.

In alternative embodiment, the triggering member 16 may be formed by two identical superposed domes arranged in the recess 40; the triggering member 16 may be a dome with rectangular or square contour and the recess has a complementary form; the actuating member 18 may not be incorporated in the switch; and the actuating member 18 may be a flexible structure fixed to the top support plate 14.

Figure 7:
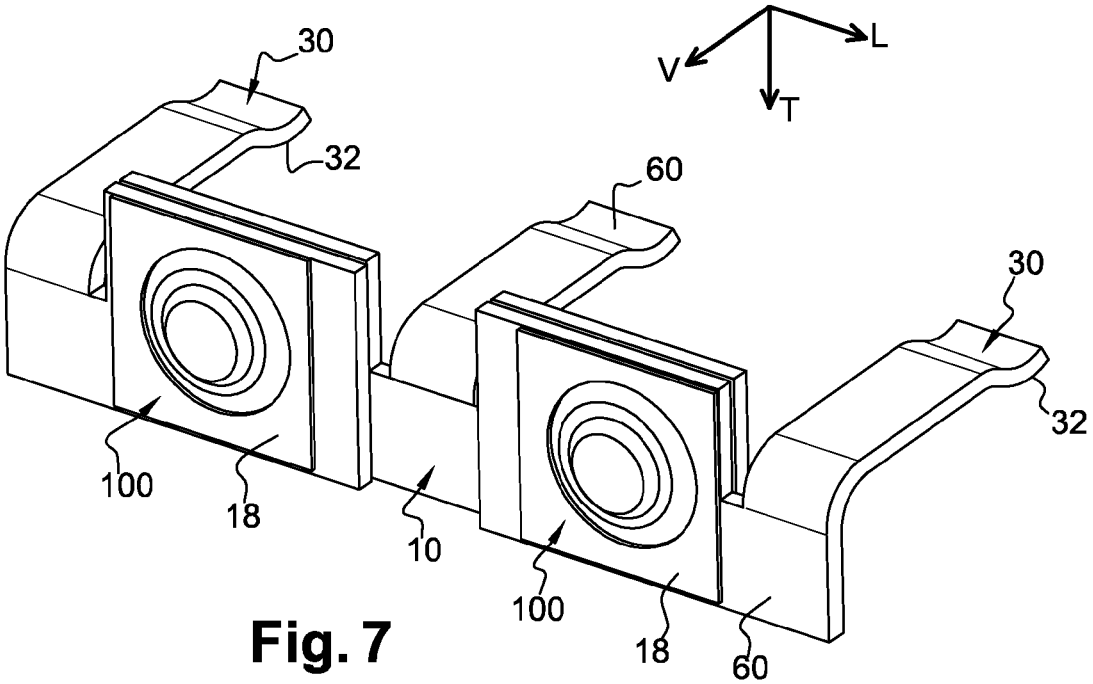
FIG. 7 illustrates a perspective view of an assembly including two electrical switches according to an embodiment the invention, the assembly comprising a common bottom contact plate.
Figure 8:
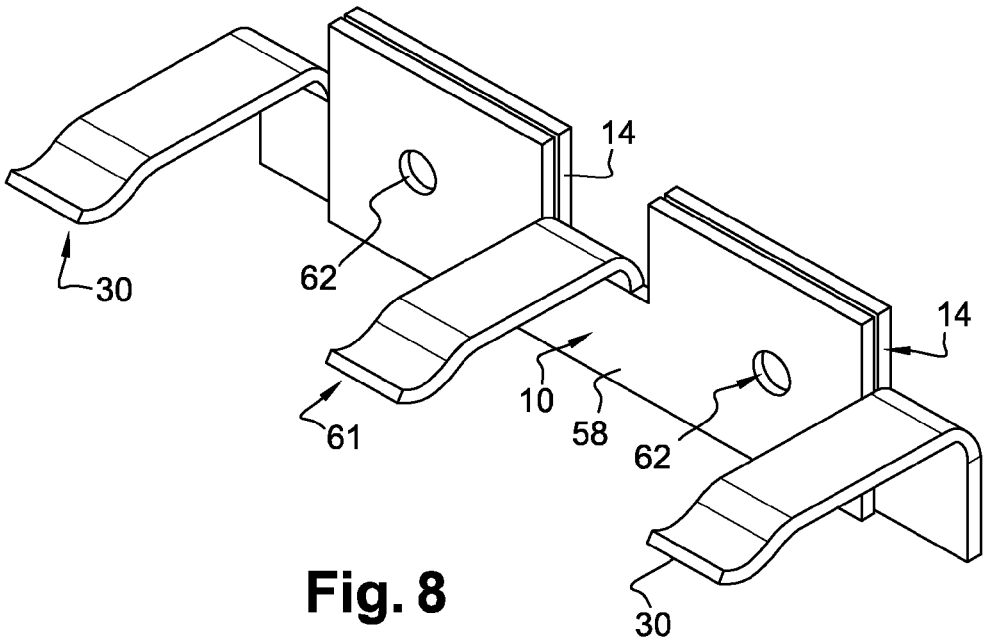
FIG. 8 illustrates a view of the assembly of FIG. 7 from a second viewing angle.
Figure 9:
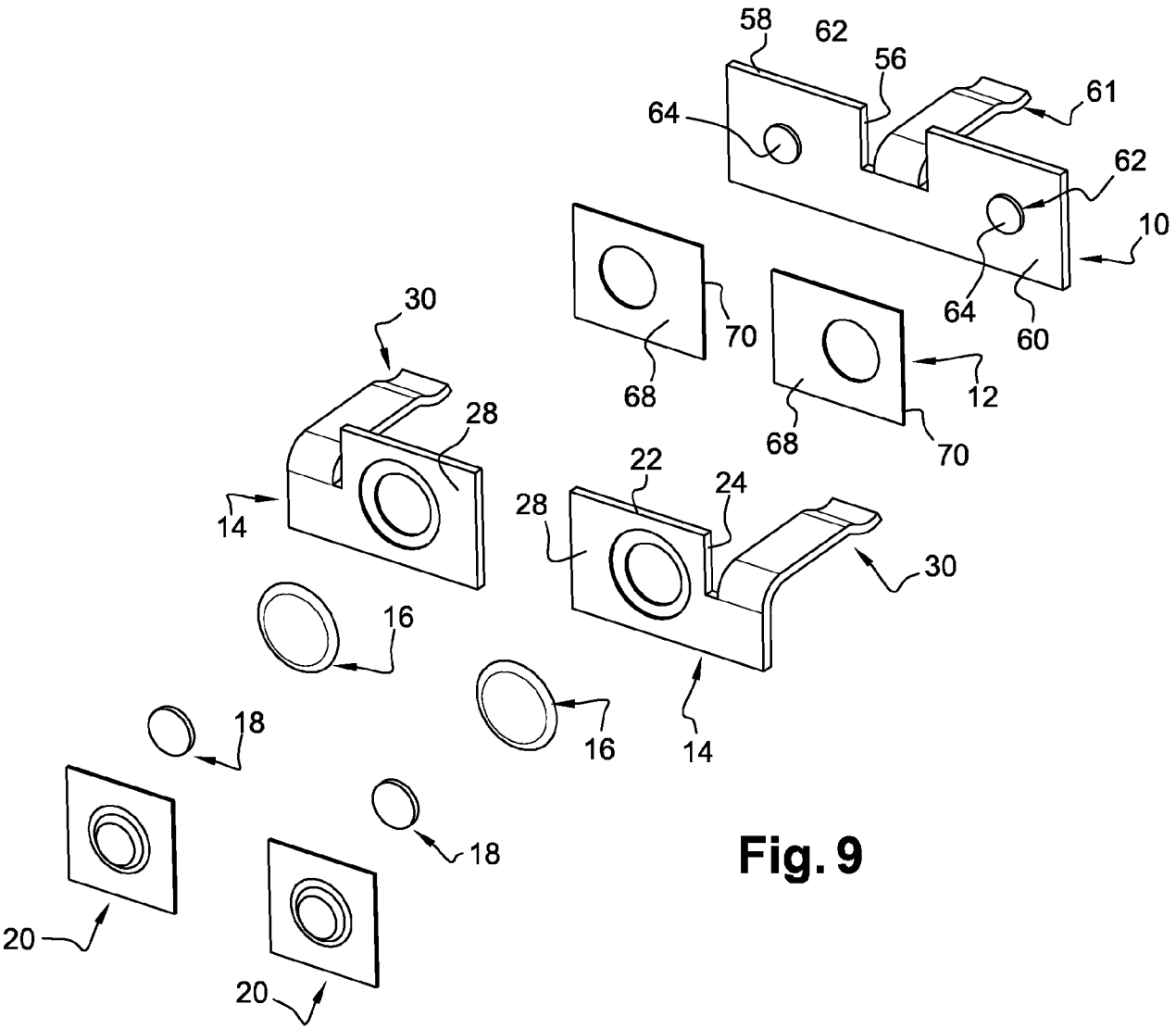
FIG. 9 illustrates an exploded perspective view of the components of the assembly of FIG. 7.

FIGS. 7 to 9 illustrate an example of an exemplary "multiple" electrical switch assembly including two electrical switches with a design similar to that which has just been described previously with regard to a single electrical switch 100. Here, an assembly may include a bottom contact plate 10 that is common to two electrical switches 100. Each top support plate 14 may have a single bent lead 30 forming a fixing and electrical connection terminal that constitutes an elastic branch making it possible to mount and connect the assembly on a top face of a printed circuit board. The common bottom contact plate 10 may extend along a lateral edge of the printed circuit board. Similarly, the bottom contact plate 10 may include a bent lead 61 forming a fixing and connection terminal which is arranged centrally between the two leads 30 of the top support plates 14.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. An electrical switch comprising:

a top support plate produced from a metal plate, the top support plate cut and shaped to delimit a recess having an annular bottom and delimiting an open first central hole;

an electrically conducting triggering member having a convex shape and is elastically deformable from a stable rest position in a direction substantially perpendicular to a bottom of the recess, the triggering member comprising a bottom edge positioned to bear vertically downward on a facing top face of the annular bottom;

a bottom contact plate produced from a cut metal plate, the bottom contact plate comprising a fixed central contact region arranged facing both the first central hole and a conductive central portion of the bottom face of the triggering member such that, upon deformation of the electrically conducting triggering member, an electric pathway is established between the conductive central portion of the triggering member and the fixed central contact region of the bottom contact plate; and an adhesive fixing insulating sheet comprising a second central hole;

wherein the insulating sheet is arranged vertically between a peripheral portion of the bottom face of the top support plate and a peripheral portion of the top face of the bottom contact plate; and wherein the insulating sheet comprises two opposite faces configured to adhere to each of said two peripheral portions to form a means for fixing the top support plate to the bottom contact plate.

2. The electrical switch of claim 1, further comprising an actuating member mounted in a movable manner relative to the top support plate in a direction substantially perpendicular to the bottom of the recess in order to act on the top face of the central portion of the triggering member.

3. The electrical switch of claim 1, further comprising a solid top closing film comprising a bottom face, wherein the bottom face of the top closing film is configured to adhere to a peripheral region of the top face of the top support plate.

4. The electrical switch of claim 1, wherein the fixed central contact region of the bottom contact plate comprises a part extending in a protruding manner offset vertically relative to the flat bottom face of the top support plate.

5. The electrical switch of claim 1, wherein the triggering member comprises a spherical cap, and wherein the recess comprises a concave cylindrical shape such that a diameter of the circular bottom edge of the triggering member is received with a radial play in the concave recess.

6. The electrical switch of claim 1, wherein the top support plate comprises at least one connection terminal comprising a cut and bent peripheral lead which extends vertically downward from the top support plate.

* * * * *